United States Patent [19]

Britton

[11] 4,295,001

[45] Oct. 13, 1981

[54] ELECTRODE SEAL

[75] Inventor: Kenneth L. Britton, Claypool, Ariz.

[73] Assignee: Inspiration Consolidated Copper Company, Inspiration, Ariz.

[21] Appl. No.: 99,632

[22] Filed: Dec. 3, 1979

[51] Int. Cl.[3] ..... H05B 7/12

[52] U.S. Cl. ..... 13/17

[58] Field of Search ..... 13/14–17

[56] References Cited

U.S. PATENT DOCUMENTS

| | | | |
|---|---|---|---|
| 1,732,431 | 10/1929 | Bruggmann . | |
| 2,979,550 | 4/1961 | Sherman, Sr. . | |
| 3,198,870 | 8/1965 | Simpkin et al. | 13/16 |
| 3,379,816 | 4/1968 | Hozven . | |
| 3,683,095 | 8/1972 | Salmin et al. . | |
| 3,709,506 | 1/1973 | Beerman . | |

FOREIGN PATENT DOCUMENTS

| | | | |
|---|---|---|---|
| 155251 | 8/1962 | U.S.S.R. | 13/17 |

*Primary Examiner*—Roy N. Envall, Jr.
*Attorney, Agent, or Firm*—Pennie & Edmonds

[57] ABSTRACT

An electrode seal for an electric furnace having an electrode moveable through an opening in the furnace roof. The seal comprises a ring partially overlying the opening and having a plurality of radially slidable refractory bricks adapted to engage and seal with the electrode. Contraction means are provided for periodically moving the bricks radially inwardly of the opening to contact the electrode. The bricks are free to move radially outwardly of the opening under force of engagement with the electrode during periods when the contraction means is inoperative.

10 Claims, 4 Drawing Figures

FIG. 1
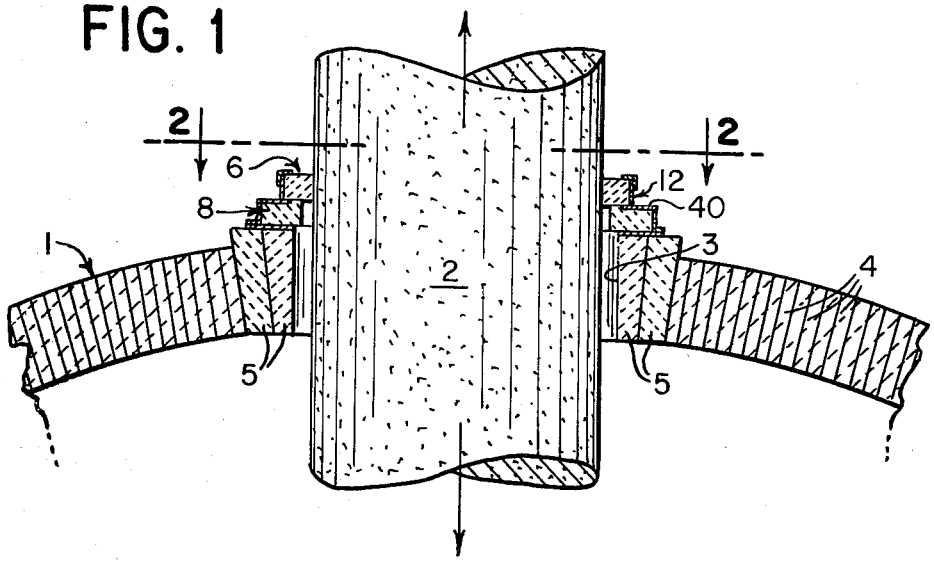
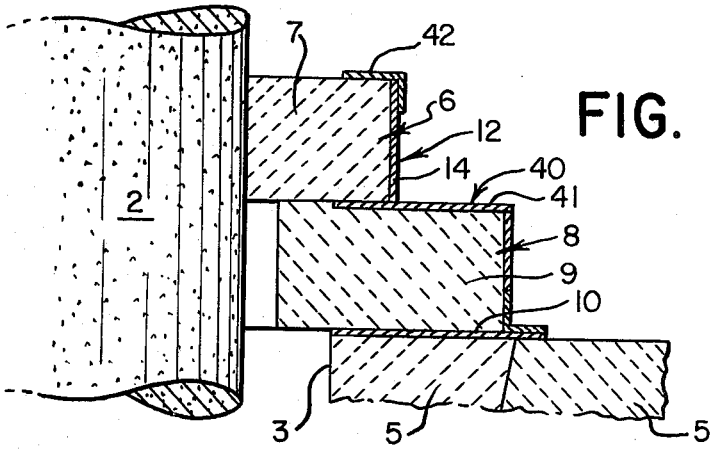
FIG. 3
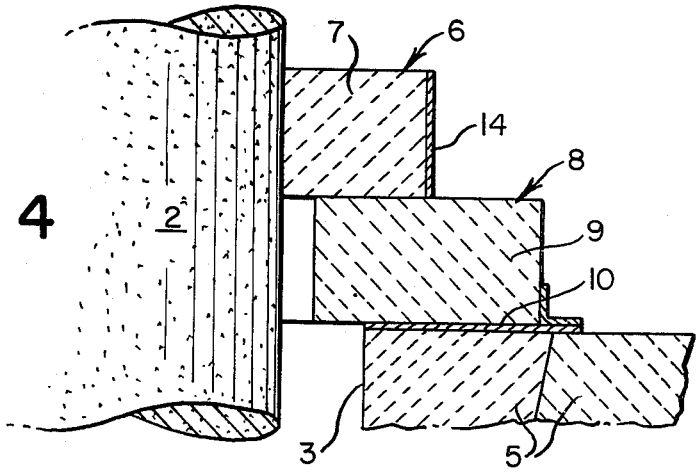
FIG. 4

ELECTRODE SEAL

FIELD OF THE INVENTION

The invention relates to an electrode seal for use in an electric furnace having at least one electrode movable into and out of the furnace through an opening in the furnace roof.

BACKGROUND OF THE INVENTION

Electric furnaces used in the refining of metals usually have a plurality of electrodes which are movable vertically through an opening in the furnace roof into and out of a bath of molten metal contained in the furnace. As material is added to or removed from the furnace, the level of the bath of molten metal within the furnace raises or lowers necessitating vertical movement of the electrodes in order that they may maintain a proper level with respect to the bath.

It is important that the opening in the furnace roof through which the electrode moves be sealed with respect to the electrode to prevent outflow of noxious gases during periods that the furnace operates under positive conditions when the internal pressure is greater than atmospheric pressure. Further, it is important to maintain an effective seal to prevent the inflow of cooling air resulting in undesirable cooling of the furnace interior when the furnace operates under negative conditions where the internal pressure is sub-atmospheric.

Various seal structure has been proposed for use with electric furnace electrodes. However, because of the high temperatures involved, uneven expansion of electrodes due to temperature differences along the length of the electrode, and difficulty in accurately forming electrodes, seal structure proposed to date has not been entirely satisfactory in use. In some instances the seal will tend to seize or bind with the electrode which can result in injury or damage to the refractory material making up the roof of the furnace when the electrode is raised or lowered. Further during periods of service, accumulations often tend to build up on the periphery of an electrode which increases any tendency of the seal to bind with the electrode.

Sealing structures have been proposed using weighted mechanical levers to force seal elements into contact with the periphery of an electrode so that the seal elements may move radially outwardly of the electrode against the force of the leveraged weights to accommodate change in diameter of the electrode or accumulation build up. However, because mechanical elements are utilized, they are susceptible to malfunctions often resulting in the sealing elements becoming jammed or stuck in place such that they bind against the electrode.

It is therefore an object of my invention to provide for an electrode seal surface which will include structure to assure a tight fitting seal with the periphery of an electrode and which at the same time will be able to move to accommodate uneven expansion of the electrode due to heat variation or to accommodate irregularities in the surface of the electrode due to build up of accumulations.

It is a further object of my invention to provide for an electrode seal which will include safety features to assure that there will be no damage imparted to the furnace roof in the event that, due to a malfunction in the seal, the seal might seize with the periphery of the electrode.

GENERAL DESCRIPTION OF THE INVENTION

Broadly, an electrode seal constructed according to the invention is adapted for use with an electric furnace having at least one electrode movable into and out of a furnace through an opening in the furnace roof. The seal structure includes a first ring made up of a plurality of radially slidable refractory bricks which partially overlie the opening in the roof and which are adapted to contact the periphery of an electrode. Contraction means are provided for periodically exerting a contraction force on the ring so as to move the individual bricks radially inwardly towards the electrode in order that they will engage and seal with the outer periphery of the electrode. The bricks are free to slide radially outwardly of the opening by force of engagement with the electrode during the period of time when the contraction means does not exert a contraction force on the movable bricks.

Preferably a second ring is provided which includes a plurality of refractory bricks which are fixed with respect to the opening and which slidably support on their upper surface the bricks of the first ring. The bricks of the first ring, which are those engaging the electrode, have a lower crushing strength than the bricks of the second ring in order to provide a fail safe feature in the event that the contraction means malfunctions resulting in the bricks of the first ring binding on being kept in sealing contact with the electrode. By making the bricks of the first ring of less strength, these bricks will tend to break up or crumble when the electrode moves into or out of the furnace before the bricks of the second ring which form part of the furnace roof. In this manner, injury to the furnace roof is prevented.

The contraction means broadly comprises a compression band which surrounds the first ring and includes a fluid motor joining the ends of the band whereby the ends of the band may be periodically moved towards each other to exert a contraction force on the band. Preferably the fluid motor is double acting in order to exert an expansion force on the band during periods of time the band is not contracted such that the bricks of the first ring may move radially outwardly of the opening in the furnace roof under force of engagement with the periphery of the electrode.

The band itself may comprise two arcuate segments with the end of the segments opposite the fluid motor being connected by a tension spring. This construction provides a still further fail safe feature in the event that the contraction means malfunctions in the contraction cycle such that the bricks of the first ring would bind with the electrode. Movement of the electrode in such a situation would allow the arcuate segments to spread against the force of the spring and to allow outward radial movement of the bricks.

A slide surface is preferably positioned between the bricks of the first and second rings in order to provide a support surface for the band. The slide surface comprises a plurality of arcuate plates which are circumferentially spaced about the opening in the furnace roof.

Hold down clips which are fixed to the top of the band extend over each brick of the first ring and serve to keep the bricks from being displaced vertically upon vertical movement of an electrode.

BRIEF DESCRIPTION OF THE DRAWINGS

FIG. 1 is a side sectional view of a portion of a furnace roof including a seal constructed according to the invention engaging an electrode;

FIG. 3 is an enlarged view of FIG. 2 taken along lines 3—3; and

FIG. 4 is an enlarged sectional view of FIG. 2 taken along line 4—4.

BEST MODE FOR CARRYING OUT THE INVENTION

Figure 2:
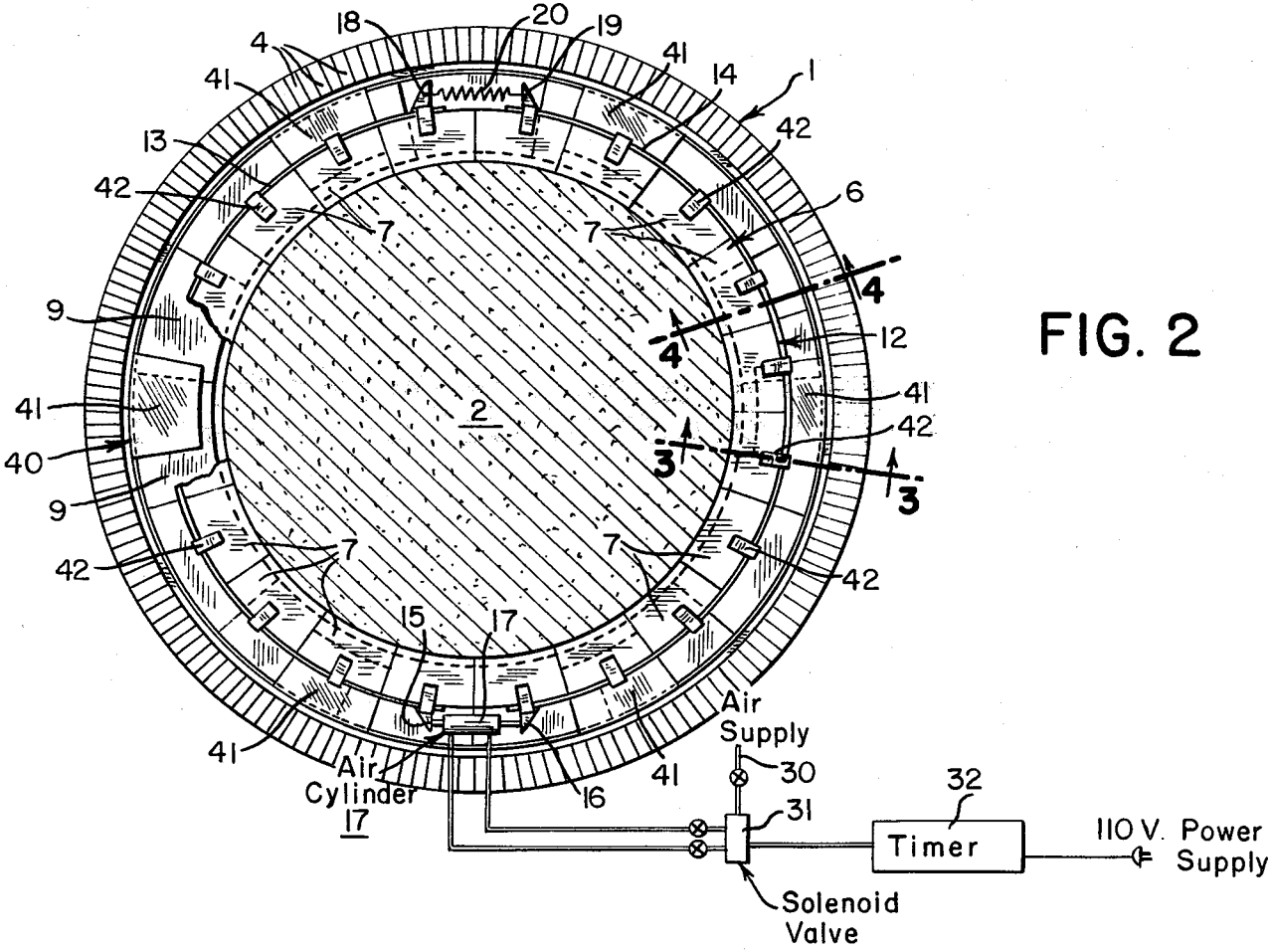
FIG. 2 is an enlarged partial sectional plan view of FIG. 1 taken along lines 2—2.

Referring to FIG. 1, there is illustrated a portion of a roof 1 of an electric furnace through which an electrode 2 is movable in a vertical direction through an opening 3 in the roof in order to maintain proper position with respect to a bath of molten metal (not shown) contained in the furnace. Roof 1 of the furnace is made up of a plurality of refractory arch bricks 4 including refractory bricks 5 which form the opening 3.

A first ring 6 comprising a plurality of radially movable refractory bricks 7 is positioned so that the bricks may engage and seal with the periphery of the electrode 2. Bricks 7 are positioned upon and are supported by a second ring 8 comprising a plurality of refractory bricks 9 which are preferably larger than bricks 7. Bricks 9 are fixed in place by mortar and rest upon a steel base plate assembly 10 which further holds the bricks 9 securely with respect to the opening 3 in the furnace roof.

A compression band 12 surrounds the ring 6 and when compressed or contracted serves to move the bricks 7 radially inwardly of the opening 3 so as to engage and seal with the electrode 2.

As shown in FIG. 2, compression band 12 comprises two arcuate segments 13 and 14 which are connected at their ends 15 and 16 to a double-acting fluid motor 17 and at their opposite ends 18 and 19 to a tension spring 20. As is apparent from FIG. 2, contractional movement of the fluid motor 17 will cause the ends 15 and 16 of the segments 13 and 14 to move towards each other so contracting the band. Operation of the fluid motor 17 in the opposite direction will move the ends 15 and 16 apart thus expanding the compression band which in turn will allow the individual bricks 7 to move radially outwardly of the opening under force of engagement with the periphery of the electrode.

Preferably the fluid motor comprises an air cylinder connected to a source of air supply 30 where control of the air cylinder is by means of a solenoid valve 31 in turn controlled by a timer 32.

Referring to FIGS. 2 and 3, a slide plate 40 is positioned on top of the ring 8 and comprises six arcuate segments 41 affixed to the base plate assembly 10 and circumferentially evenly spaced about the opening 3. The slide plates serve to support the end and middle portions of segments 13 and 14 and provide a surface upon which these segments may slide.

A plurality of hold down clips 42 are fixed to the top of the segments 13 and 14 making up the compression band so that there is one clip for each brick 7. These clips serve to prevent vertical dislodgement of the bricks 7 from the first ring 6 on upward movement of the electrode.

Preferably the timer 32 is set so that a contraction force is exerted by the air cylinder on the compression band 12 for a period of one second once every five minutes with the air cylinder exerting an expansion force on the band during the remaining five-minute period. This action allows the bricks making up the first ring to be radially movable for a period of five minutes under the force of engagement with the sides of the electrode as might occur due to increase in diameter of the electrode because of expansion due to uneven heating or because of build up of accumulations on the periphery of the electrode. The contraction period of one second serves to reposition the bricks 7 making up the first ring to move them inwardly towards the electrode in order that they may reseal with the electrode in the event that they have been moved radially outwardly during the five-minute band expansion period. The exact period of contraction and expansion of the band may be varied to accommodate different conditions as may be caused by speed of axial movement by the electrode, rate of temperature change in the furnace and other operating conditions.

Preferably the crushing strength of the bricks 7 making up the first ring is less than the crushing strength of the bricks 9 making up the second ring. This assures that in the event there is any malfunction of the fluid motor or other parts such that the moveable bricks 7 would jam or stick in place and bind with the electrode, these bricks will break and crumble on any movement of the electrode before bricks 9 or the remainder of the bricks making up the roof of the furnace. For example bricks 7 may have a crushing strength of 300 psi while bricks 9 would have a much greater crushing strength.

The hold down clips 42 provide a minimum holding force on the individual bricks 7 with which they contact, and because they are placed on the outside circumference of the bricks, allow the individual bricks to "roll out" of the compression band in the event that they bind with the electrode or become wedged between the electrode and the fixed bricks 9.

Further protection is provided in the event of any malfunction of the seal in that the spring 20 provides an emergency expansion point in the event that the fluid motor fails in the contracted position. That is to say, the ends 18 and 19 of the segments 13 and 14 making up the compression band 12 would be free to move apart against the force of the tension spring so allowing the bricks 9 to move radially outwardly under the force of engagement with the electrode.

Movement of the electrode during the brief one-second period that the fluid motor contracts the compression band or while the bricks 7 maintain sealing contact with the electrode results in no damage to the parts making up the seal even though the effective diameter of the electrode is increased. The "roll out" feature allows slight lifting of the bricks 7 upon upward movement of the electrode with the bricks then falling back into position as soon as the expansion cycle of the fluid motor comes into effect. Downward movement of the electrode during this same brief period is accommodated by the spring 20.

A further important result from utilizing a seal constructed according to the invention is that the intermittent contractions of the compression band results in little wear on the blocks 7.

I claim:

1. An electrode seal for an electric furnace having at least one electrode movable into and out of said furnace through an opening in the furnace roof wherein said seal comprises a first ring including a plurality of radially slidable first refractory bricks partially overlying said opening and adapted to contact and seal with the periphery of said electrode, and contractions means for periodically exerting a contraction force on said first ring to slide said first refractory bricks radially inwardly towards said electrode until said first refractory bricks contact and seal with the periphery of said electrode and wherein said first refractory bricks are free to slide radially outwardly of said opening under force of engagement with the periphery of said electrode during periods of time when said contraction means does not exert a contraction force on said first ring.

2. An electrode seal according to claim 1 having in addition a second ring including a plurality of second refractory bricks fixed with respect to and surrounding said opening wherein said second ring supports said first ring and wherein said first bricks have a lower crushing strength than said second bricks.

3. An electrode seal according to claim 1 wherein said contraction means comprises a compression band surrounding said first ring and a fluid motor joining the ends of said band for providing movement of said ends towards each other to contract the band for exerting a contraction force on said first ring and for providing movement of the ends of said band away from each other to expand the band to allow said first bricks to move radially outwardly of the opening under force of engagement with the periphery of the electrode.

4. An electrode seal according to claim 3 wherein said band comprises at least two arcuate segments with the ends of said segment opposite said fluid motor being connected by a tension spring.

5. An electrode seal according to claim 3 having in addition a slide surface positioned between said ring and the roof of said furnace to slidably support said band.

6. An electrode seal according to claim 5 wherein said slide surface comprises a plurality of arcuate plates circumferentially spaced about said opening.

7. An electrode seal according to claim 6 wherein said compression band has a plurality of hold down clips fixed thereon with at least one hold down clip overlying and contacting the upper surface of each first brick.

8. An electrode seal according to claim 1 wherein the period of time that said contraction means exerts a contraction force is less than the period of time that the contraction means does not exert a contraction force.

9. An electrode seal for an electric furnace having at least one electrode movable axially into and out of said furnace through an opening in the furnace roof wherein said seal comprises a first ring including a plurality of radially slidable refractory bricks partially overlying said opening and adapted to contact and seal with the periphery of said electrode, a second ring including a plurality of fixed refractory bricks fixed with respect to and surrounding said opening with said second ring supporting said slidable bricks, a compression band surrounding said first ring and a fluid motor joining the ends of said band for periodically imparting movement of said ends towards each other to contract said band to exert a contraction force on said first ring during a contraction period to position said first bricks into sealing contact with the periphery of the electrode and for imparting movement of the ends of said band away from each other to expand the band during an expansion period to allow said first bricks to move radially outwardly of the opening under force of engagement with the periphery of the electrode.

10. An electrode seal according to claim 9 wherein the crushing force of said slidable bricks is less than the crushing force of said fixed bricks.

* * * * *